US005207783A

United States Patent [19]

Burton

[11] Patent Number: 5,207,783

[45] **Date of Patent: * May 4, 1993**

[54] SAFETY CLOSURES FOR CONTAINERS

[75] Inventor: George W. Burton, London, United Kingdom

[73] Assignee: Johnsen & Jorgensen Plastics Limited, London, United Kingdom

[ * ] Notice: The portion of the term of this patent subsequent to Sep. 4, 2008 has been disclaimed.

[21] Appl. No.: 246,867

[22] Filed: Sep. 20, 1988

[30] Foreign Application Priority Data

Sep. 21, 1987 [GB] United Kingdom ..... 8722126

[51] Int. Cl.[5] ..... B65D 41/32

[52] U.S. Cl. ..... 215/256; 215/253; 215/258; 215/235

[58] Field of Search ..... 215/252, 253, 254, 256, 215/258

[56] References Cited

U.S. PATENT DOCUMENTS

| | | | |
|---|---|---|---|
| 3,812,991 | 5/1974 | Wurl | 215/252 |
| 3,927,784 | 12/1975 | Cochrane | 215/256 |
| 3,991,904 | 11/1976 | Davis et al. | 220/334 |
| 4,199,071 | 4/1980 | D'Amico | 215/256 |
| 4,342,400 | 8/1982 | Llera | 215/256 |
| 4,372,456 | 2/1983 | Guala | 215/252 |
| 4,417,666 | 11/1983 | Roberts | 215/256 |
| 4,449,639 | 5/1984 | Davis | 215/224 |
| 4,531,650 | 7/1985 | Friendship | 215/256 |
| 4,597,500 | 7/1986 | Stubbs | 215/256 |
| 4,635,808 | 1/1987 | Nolan | 215/252 |
| 4,720,018 | 1/1988 | Schetzsle et al. | 215/252 |
| 4,805,792 | 2/1989 | Lecinski, Jr. | 215/253 |
| 4,846,361 | 7/1989 | Haffner | 215/252 |
| 4,909,404 | 3/1990 | Rozenberg | 215/220 |
| 4,919,286 | 4/1990 | Agbay, Sr. | 215/235 |
| 4,984,701 | 1/1991 | Margaria | 215/256 |

*Primary Examiner*—Allan N. Shoap
*Assistant Examiner*—Vanessa Caretto
*Attorney, Agent, or Firm*—Banner, Birch, McKie & Beckett

[57] ABSTRACT

The present invention provides a one piece plastic closure of the type including a cap part, a tear band which is removable and an anchor band. A hinge member connects the anchor band to the cap part so that when the tear band is removed, the cap part can hinge relative to the anchor band. The anchor band is intended to be retained by the container to which the closure is applied by push fitting so that the anchor band cannot be removed from the container. The invention further provides weakened sections in the anchor band which will fracture if an attempt is made to pry the closure from the container without removal of the tear band, but which will remain intact when the closure is applied to the container by push fitting.

8 Claims, 4 Drawing Sheets

SAFETY CLOSURES FOR CONTAINERS

This invention relates to closures for containers. Our safety closures known under our Registered Trade Mark JAYCAP have proved very popular mainly because a JAYCAP closure is initially tamper evident and after removal can easily be hingedly replaced in position to close the associated container. A JAYCAP closure comprises a cap part to close the mouth of the container, an anchor band to be secured around the neck of the container, a tamper evident tear away band disposed between the anchor band and the cap part and connected to the anchor band and to the cap part by frangible means and finally a hinge connecting the cap part to the anchor band so that when the tear band has been removed the cap part may be hingedly moved from a closed position to an open position and vice versa.

Our JAYCAP closures have been on the market for about twenty years and from time to time we receive reports from customers that attempts have been made to "persuade" a JAYCAP closure off a container in an unauthorized way without breaking the frangible means so that the tear band remains in position. A recent attempt of this nature has involved the immersion of a JAYCAP closure, when in position on a container, in hot water to soften the plastics material of which the closure is made. While such attempts almost always end in failure we are always looking at ways in which the tamper resistance of a JAYCAP or like closure can be improved and it is the main object of this invention to provide a tamper evident closure in which the resistance to tampering is improved.

SUMMARY OF THE INVENTION

In accordance with this invention we provide a closure comprising a cap part with a depending skirt, a tear band connected to the bottom of the skirt by frangible safety means, an annular anchor band connected to the bottom of the tear band by frangible safety means and a hinge connecting the anchor band to the skirt characterized in that the annular anchor band is divided into separable sections by frangible indicating means extending across the width of the anchor band so that if an attempt be made to "persuade" the closure off a container without tearing away the tear band the frangible indicating means will break as the closure is moved upwardly over a retaining bead around the neck of the container. The frangible indicating means may extend vertically upwards from the bottom of the anchor band, across the band to the top where the indicating means joins the safety means but we prefer to provide indicating means extending obliquely at an angle across the anchor band to minimize the risk of breakage when the closure is initially applied to a container. The tear band is provided with a tear or grip tab by means of which the tear band may be torn away and to minimize the risk of the frangible indicating means breaking when the tear band is being torn away in a normal manner we prefer to arrange the frangible indicating means to extend upwardly at an angle away from the tear tab. In this way the anchor band may be divided into two, three or more separable sections, four sections being preferred, and the sections may be all the same length or may be of different lengths. The frangible indicating means may consist of tongues or nibs or may simply be, in each case, a weakened membrane.

In order to improve the frangibility of the indicating means and to provide a more simple design, the locating bead on the inside of the anchor band may be provided with gaps, the or each gap coinciding with the provision of an indicating means. These gaps in the bead may be angled to match the angle of the frangible indicating means.

We prefer to make the closures of low density polyethylene (LDPE) but if desired 10% or 25% or such other proportion as may be selected of high density polyethylene (HDPE) may be added.

BRIEF DESCRIPTION OF THE DRAWINGS

In order that the invention may be more clearly understood reference is now directed to the accompanying drawings, given by way of example in which.

DETAILED DESCRIPTION OF THE INVENTION

Figure 1:
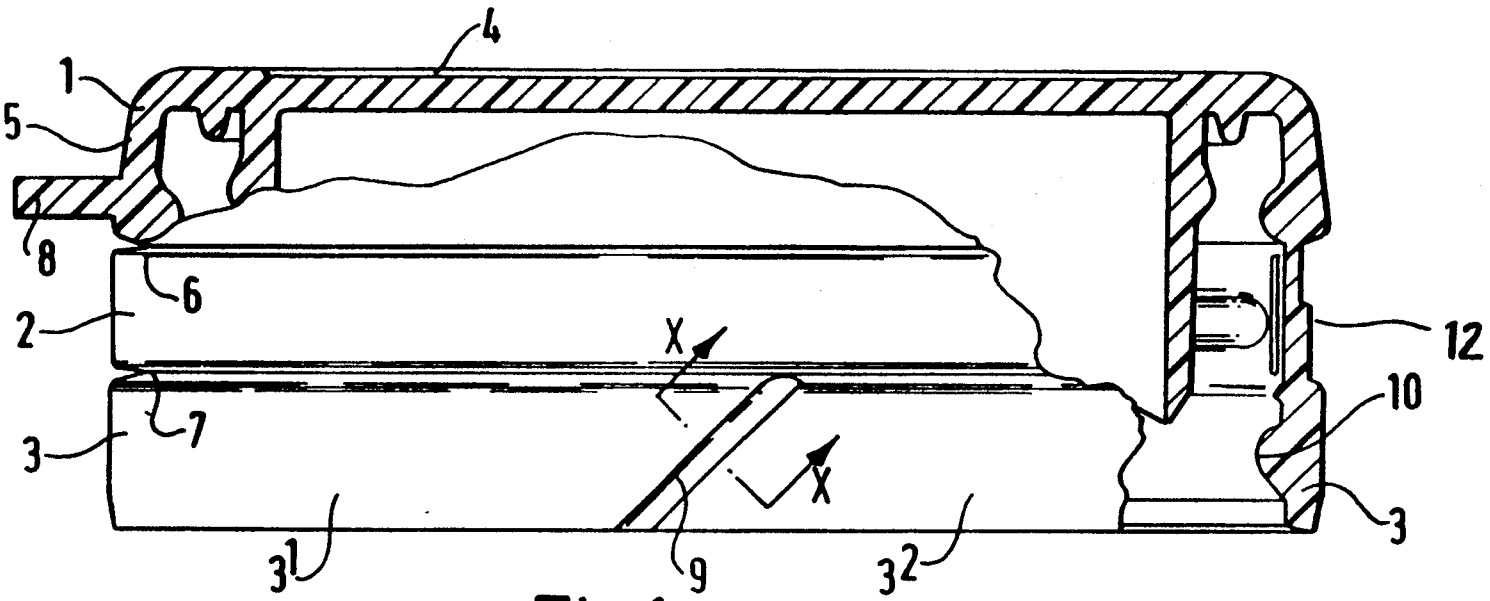
FIG. 1 is a vertical cross-section of one form of closure, in accordance with the invention, on the line C—C of FIG. 2.
Figure 3:
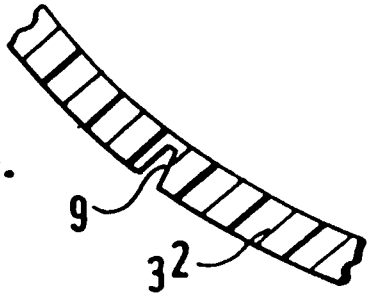
FIG. 3 is a detailed sectional view on the line X—X of FIG. 1.
Figure 2:
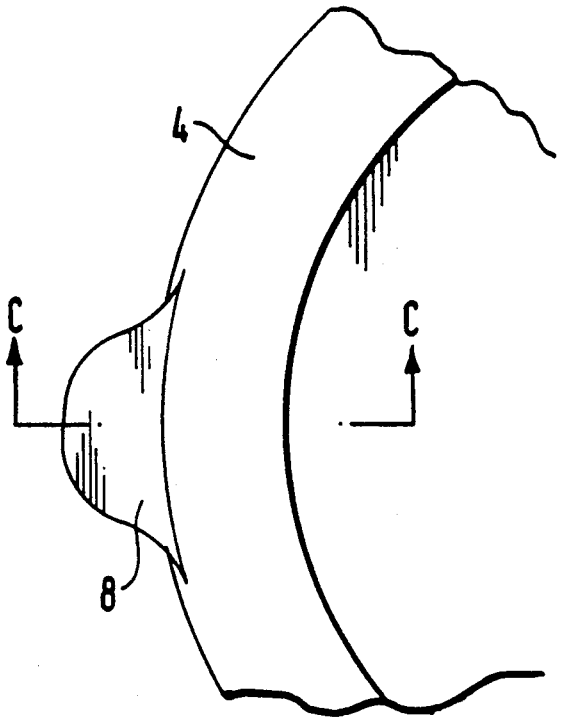
FIG. 2 is a partial top plan view.

Referring to the drawings the closure comprises a cap part 1, a tear band 2 and an anchor band 3. The cap part 1 has a top 4 and a depending skirt 5, the top of the tear band 2 being connected to the bottom of the skirt 5 by frangible line of weakness 6. The bottom of the tear band 2 is connected to the top of the anchor band 3 by a second line of weakness 7. The skirt 5 of the cap part 1 is provided with a thumb tab 8 to assist in opening the closure when the tear band 2 has been torn away and a hinge 12 is provided connecting skirt 5 to anchor band 3 to assist in the resealing of the closure. So far the description of the illustrated embodiment relates to a conventional JAYCAP closure but in accordance with this invention the anchor band 3 is divided into two or more separable sections $3^1$ and $3^2$ by the provision of at least one and preferably four angularly extending frangible indicating membranes 9. In the embodiment illustrated in FIGS. 1 to 3, there are two frangible membranes 9. The anchor band 3 may have an internal projecting bead 10 which rides over an external bead around the neck of a container when the closure is first applied to a container, e.g., by a conventional capping machine which can bang the closure on vertically downwardly. In accordance with a feature of this invention, the bead 10 is divided or interrupted by the provision of a gap or gaps, the or each gap coinciding with the position of a membrane 9.

Figure 7:
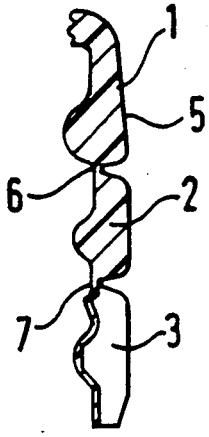
FIG. 7 is a sectional view of an alternate embodiment of the present invention in which the membranes follow the profile of the anchor band.
Figure 4:
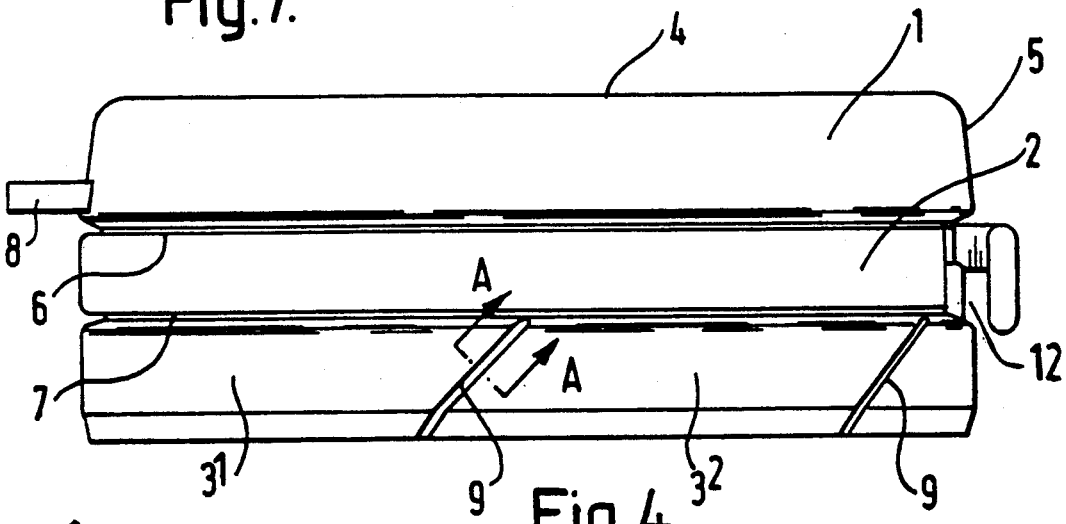
FIG. 4 is a side elevation of the embodiment of the present invention incorporating multiple membranes.
Figure 6:
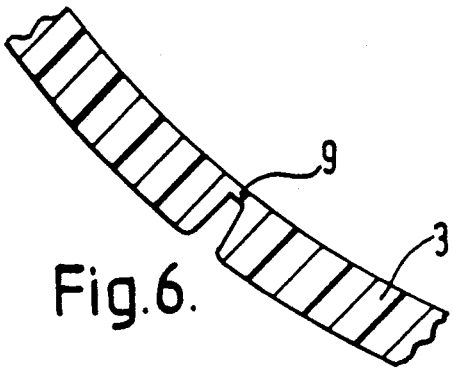
FIG. 6 is an enlarged sectional view along line A—A of FIG. 4.
Figure 5:
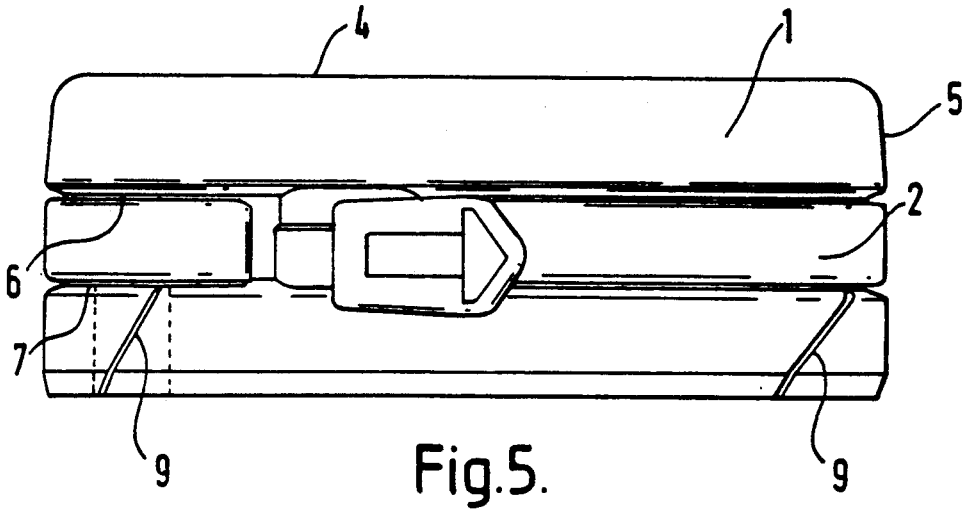
FIG. 5 is a side elevation rotated 90° from FIG. 4.
Figure 8:
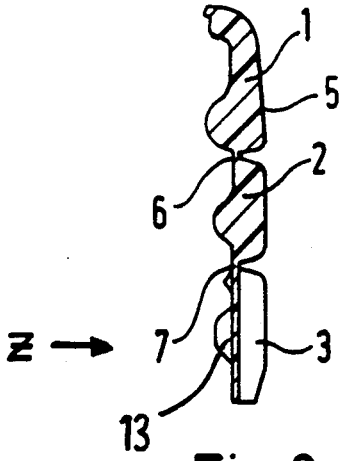
FIG. 8 is a sectional view of another alternate embodiment of the present invention.
Figure 9:
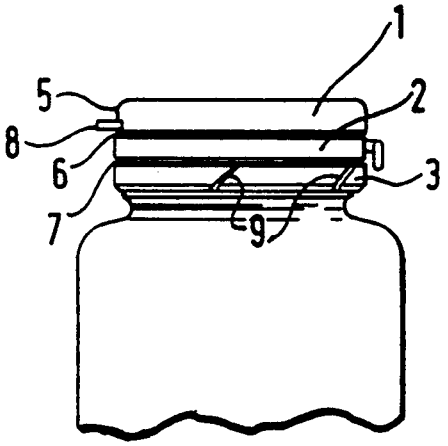
FIG. 9 is a side elevation of a closure according to the invention in position on a container.
Figure 10:
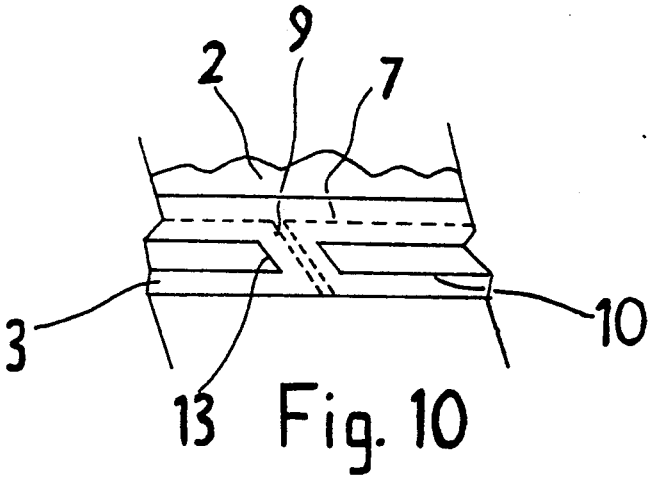
FIG. 10 is a sectional view showing the interior of the anchor band when viewed in the direction of the arrow Z shown in FIG. 8.

FIGS. 4 to 9 show various views of an embodiment of the invention including four weakened membranes 9 in the anchor band. FIGS. 4 and 5 are side elevations of a closure in accordance with the invention with the closure turned through 90° in FIG. 5 as compared with FIG. 4. FIG. 6 is a section to an enlarged scale on the line A—A of FIG. 4. FIG. 7 is a sectional view of an embodiment in which the membranes 9 follow the profile of the anchor band and FIG. 8 is a sectional view of another embodiment in which the internal bead on the anchor band is removed locally in the vicinity of each membrane 9 which provides a more simple design. FIG. 10 is a sectional view showing the interior of the anchor band 3 when viewed in the direction of the arrow Z shown in FIG. 8. FIG. 9 shows a closure according to the invention in one actual size in position on a container. Naturally closures of any suitable size may be provided to fit containers.

What is claimed is:

1. A plastics material, one-piece closure for a container wherein the closure is adapted to be push fitted onto the container and comprises a cap part with a depending skirt having a top connected to the cap part and a bottom, a tear band having a top and bottom, the top of the tear band being connected to the bottom of the skirt by frangible safety means, an annular anchor band having a top and a bottom, the top of the anchor band being connected to the bottom of the tear band by frangible safety means and a hinge member connecting the anchor band to the skirt and by which the skirt and cap part may be hinged relative to the anchor band after the tear band has been removed characterized in that the annular anchor band is divided into separate sections by frangible indicating means for indicating that tampering has occurred and for indicating that an upwards force has been applied to the closure with said tear band in place, said frangible indicating means comprising lines of weakening across the width of the anchor band, the frangible indicating means remaining unbroken when the closure is opened in normal use, and the frangible indicating means breaking only as the closure is moved upwardly over a retaining bead around the neck of the container when an upward force is applied to persuade the closure off the container without tearing away the tear band to thereby indicate that tampering has occurred.

2. A closure according to claim 1 characterized in that the frangible indicating means extend substantially vertically upwards or extend obliquely upwards from the bottom of the anchor band across the anchor band to the top thereof where the indicating means joins the safety means connecting the anchor band to the tear band.

3. A closure according to claim 1 or 2 characterized in that the tear band is provided with a grip tab by means of which the tear band may be torn away and the frangible indicating means extend upwardly at an angle away from the grip tab.

4. A closure according to claim 1 or 2 characterized in that the anchor band is divided into two, three, four or even more separable sections by the frangible indicating means.

5. A closure according to claim 1 or 2 characterized in that the frangible indicating means comprise lines of weakening.

6. A closure according to claim 1 characterized in that the frangible indicating means comprise spaced lines of weakening extending at an angle from the bottom to the top of the anchor band and in that the anchor band has an internal substantially annular locating bead which is provided with gaps positioned to coincide with the lines of weakening and which are angled to coincide with or match the angle of the lines of weakening.

7. A closure according to claim 3 characterized in that the frangible indicating means comprise lines of weakening.

8. A closure according to claim 4 characterized in that the frangible indicating means comprise lines of weakening.

* * * * *